United States Patent [19]

Ogata

[11] Patent Number: 4,459,771

[45] Date of Patent: Jul. 17, 1984

[54] SELF CLEANING STEAM IRON

[75] Inventor: Nobutaka Ogata, Hirakata, Japan

[73] Assignee: Matsushita Electric Industrial Co., Ltd., Osaka, Japan

[21] Appl. No.: 330,322

[22] Filed: Dec. 14, 1981

[30] Foreign Application Priority Data

Feb. 14, 1981 [JP] Japan ..... 56-19563

[51] Int. Cl.[3] ..... D06F 75/18

[52] U.S. Cl. ..... 38/77.8; 38/77.3

[58] Field of Search ..... 38/77.5, 77.8, 77.81, 38/77.82, 77.83, 77.9, 77.3; 222/386

[56] References Cited

U.S. PATENT DOCUMENTS

| | | | |
|---|---|---|---|
| 1,182,923 | 5/1916 | Mickley | 222/386 X |
| 3,346,147 | 10/1967 | Higgins et al. | 222/386 X |
| 3,413,741 | 12/1968 | Schwartz, Jr. et al. | 38/77.3 |
| 3,576,276 | 4/1971 | Clarke | 222/386 X |
| 3,599,357 | 8/1971 | Gronwick et al. . | |
| 3,747,241 | 7/1973 | Davidosn . | |

FOREIGN PATENT DOCUMENTS

| | | | |
|---|---|---|---|
| 2650837 | 11/1976 | Fed. Rep. of Germany | 38/77.8 |

*Primary Examiner*—Werner H. Schroeder
*Assistant Examiner*—Andrew M. Falik
*Attorney, Agent, or Firm*—Barnes, Kisselle, Raisch, Choate, Wittemore & Hulbert

[57] ABSTRACT

A steam iron set including a water pump mountable on a steam iron in exchange for a detachable reservoir for containing steam generating water. The water pump forces out water toward the soleplate of the iron to pass the water through a steam generating chamber and a steam channel formed in the soleplate and discharge the water from steam vents formed in the ironing surface. Fur particles or like evaporation deposit, lint, etc. can be removed from the interior of the soleplate by the flow of water to eliminate the likelihood that the flow of the steam will be impeded during ironing.

9 Claims, 4 Drawing Figures

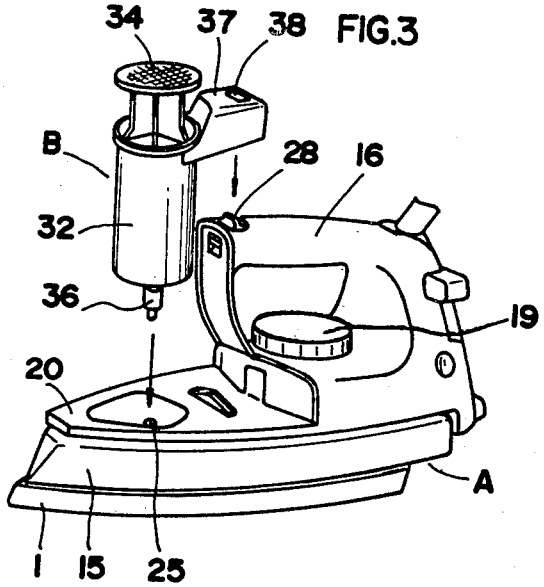
FIG.3
FIG.4
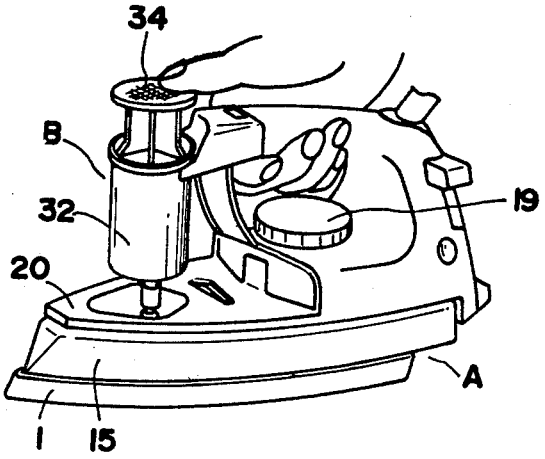

SELF CLEANING STEAM IRON

The present invention relates to a steam iron in which the water supplied from a reservoir is instantaneously evaporated to discharge the steam from steam vents formed in its ironing surface, and more particularly to a steam iron set incuding an attachment for cleaning the interior of the iron.

Generally tap water is used for steam irons. When hard, the water contains lime, calcium carbonate and other chemical substances which are dissolved or suspended therein. When such water evaporates, these substances remain as a deposit in a steam generating chamber formed in the soleplate, the steam channel and the interior of the steam vents formed in the ironing surface and communicating with the channel. If the iron is used for a prolonged period of time, the deposit will clog up the steam channel or steam vents.

The deposit may be partially removed by means of a brush or pin or the like, but such cleaning procedure is difficult and cumbersome.

To overcome the above drawback, a steam iron has been invented which is equipped with a self-cleaning device as disclosed, for example, in U.S. Pat. No. 3,747,241. The self-cleaning device is adapted to cause a large amount of water to flow onto the soleplate from a reservoir above the soleplate through an opening formed in the bottom of the reservoir and to flow out through a steam channel and steam vents formed in the soleplate. Lint and evaporation deposit lodging in the channel and vents can be washed away by the steam produced by the partial evaporation of the water flowing onto the soleplate and also by the water heated on the soleplate. The self-cleaning device is provided with a valve for opening and closing the bottom opening of the reservoir and manual means for operating the valve. The valve and the manual means are coupled to each other and attached to the reservoir.

However, the self-cleaning device has the following drawbacks. First, since the water remaining in the reservoir is allowed to flow onto the soleplate by gravity, the water will not strike the soleplate with force, failing to completely remove lint and evaporation deposit from the steam channel and steam vents. Further because the water used for self-cleaning is that which remains in the reservoir after ironing, the amount of water available is in many cases insufficient.

Second, the manual means for self-cleaning is provided on the handle or like portion of the iron main body within easy reach of the hand so as to be operable by the user at any time. This involves a hazard if the manual means is operated by the user inadvertently. For example, when it is accidentally manipulated during ironing, the water flowing from the reservoir onto the soleplate turns into steam and hot water, which jet out from the steam vents to wet or stain the floor or the clothes being ironed. Oftentimes scalding the human body exposed thereto.

Third, the self-cleaning device is inconvenient to operate manually. Both hands are required since the iron is held in a horizontal position by one hand gripping the handle and the manual means is manipulated by the other hand.

Besides the above device wherein water is allowed to flow from the reservoir onto the soleplate by gravity by opening the valve provided at the bottom opening of the reservoir, another steam iron is also known which is disclosed in U.S. Pat. No. 3,599,357 and has incorporated therein a manual pump, such that water is supplied from a reservoir to the soleplate by manually moving the pump up and down. While the iron is adapted to supply water dropwise from a reservoir to a steam generating chamber usually at a constant rate, the iron is also so designed that a temporarily increased amount of water can be supplied to the soleplate to obtain an increased amount of steam. The main purpose of this arrangement is to quickly remove stubborn wrinkles from clothes by means of the temporarily increased amount of steam. The amount of stream is controllable by the user; the amount of water can be increased by depressing several times a button connected to the pump. When a large amount of water is supplied to the soleplate at a time, the temperature of the soleplate rapidly drops. If the amount of water exceeds the evaporating capacity, the water remains as a liquid without evaporation, and hot water flows out from steam vents. Accordingly, although such a steam iron is intended to supply a temporarily increased amount of steam during ironing, the iron achieves an effect similar to that produced by the previously described self-cleaning device when the user operates the pump to an extent exceeding the evaporating capacity of the water.

In this case, however, various drawbacks are experienced in using the iron. The chief inconvenience is that the operating button must be moved up and down continuously. Additionally there is no clear distinction between the operation for increasing the steam supply and the operation for achieving the same effect as cleaning. Consequently if the button is not operated properly when it is desired to increase the steam supply during ironing, hot water is likely to jet out from the steam vents.

In view of the foregoing drawbacks, the object of the present invention is to provide a steam iron set including a cleaning attachment of simple construction by which evaporation deposits, lint, etc. can be removed effectively and reliably from the steam generating chamber, steam channel and steam vents and which is unlikely to be operated in an unintended manner.

To fulfill this object, the present invention provides a steam iron set comprising a soleplate having a heater, a steam generating chamber formed in the soleplate, a steam channel for guiding the steam generated in the steam generating chamber to steam vents formed in an ironing surface, an iron main body having a fixed handle above the soleplate, a reservoir detachably mountable on the iron main body and provided at its bottom with an outlet nozzle connectable to passage means communicating with the steam generating chamber, the reservoir further being provided with means for controlling the supply of water to the steam generating chamber though the outlet nozzle, and a water pump mountable on the iron main body in place of the reservoir and having a discharge nozzle connectable to the passage means, the water pump being adapted to forcibly release water therefrom, pass the water through the steam generating chamber and the steam channel and vigorously discharge the water from the steam vents.

According to the above construction, the cleaning attachment is provided as a water pump, from which water can be forced out to achieve a higher cleaning effect than is attained by the cleaning device which utilizes simple gravity flow of water. Since the water pump is mounted on the iron main body in place of the reservoir only when cleaning, there is no likelihood that the pump will be erroneously operated during ironing. Thus the iron can be cleaned reliably only when required. Further because the passage means communicating with the steam generating chamber is connectable to both the discharge nozzle of the water pump and the outlet nozzle of the reservoir, the pump and the reservoir are easily interchangeable by means of simple construction and without necessitating additional parts.

According to a preferred embodiment of the invention, the water pump comprises a cylinder having the discharge nozzle at its lower end and a piston slidable in the cylinder.

With this embodiment, all of the cleaning water contained in the cylinder can be forced out from the discharge nozzle by pushing the piston only once, so that the iron can be cleaned easily, quickly and effectively. The water pump is operable for cleaning simply by pushing the piston by the same hand used to hold the iron. The pump is therefore convenient to use.

Various features and advantages of the present invention will be easily understood from the embodiment to be described below with reference to the accompanying drawings, in which:

FIG. 3 is a perspective view showing how to attach the water pump to the main body of the iron; and FIG. 4 is a perspective view showing how to operate the water pump for cleaning.

Figure 1:
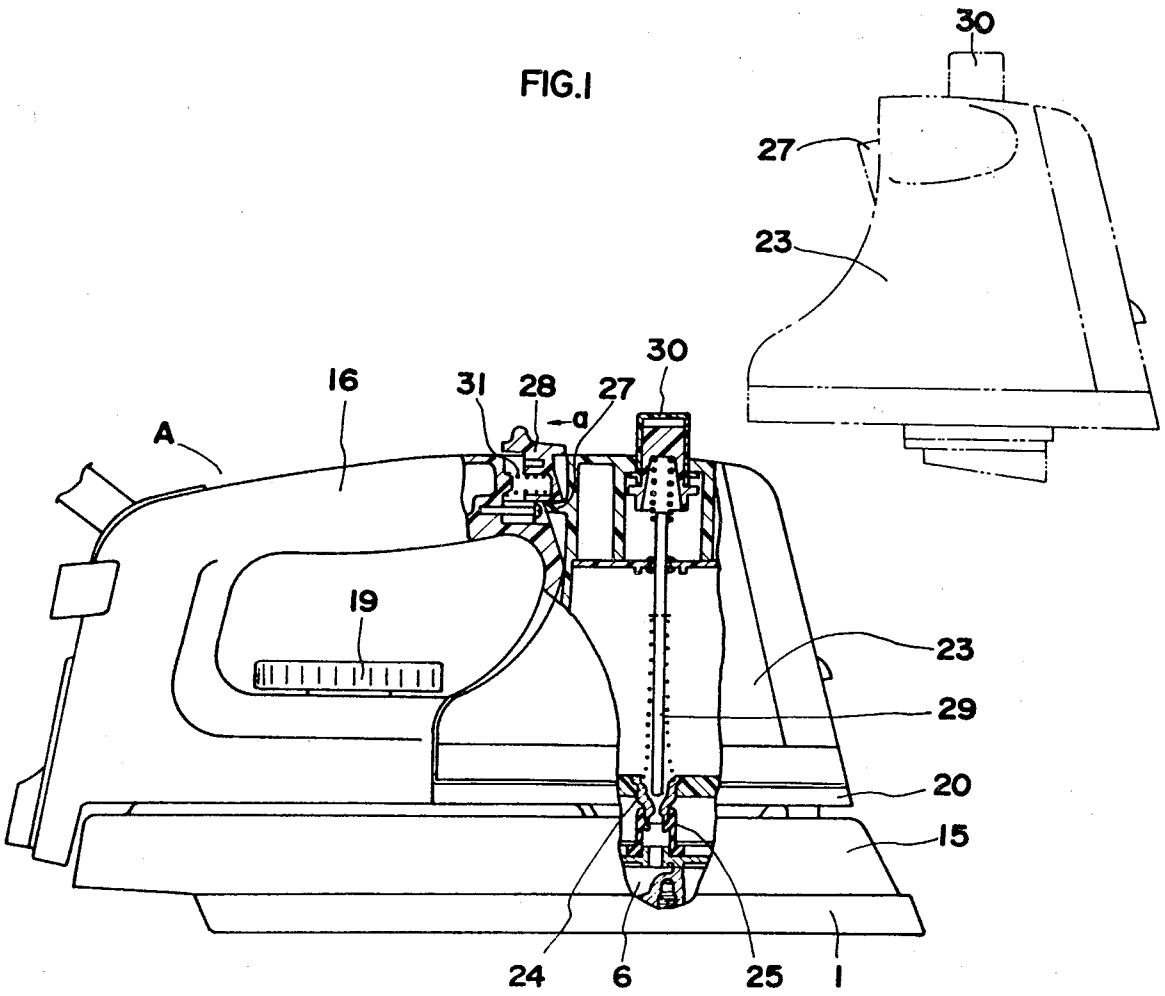
FIG. 1 is a view partly in section and showing a steam iron with a reservoir mounted in place and also in a detached state in phanton lines.
Figure 2:
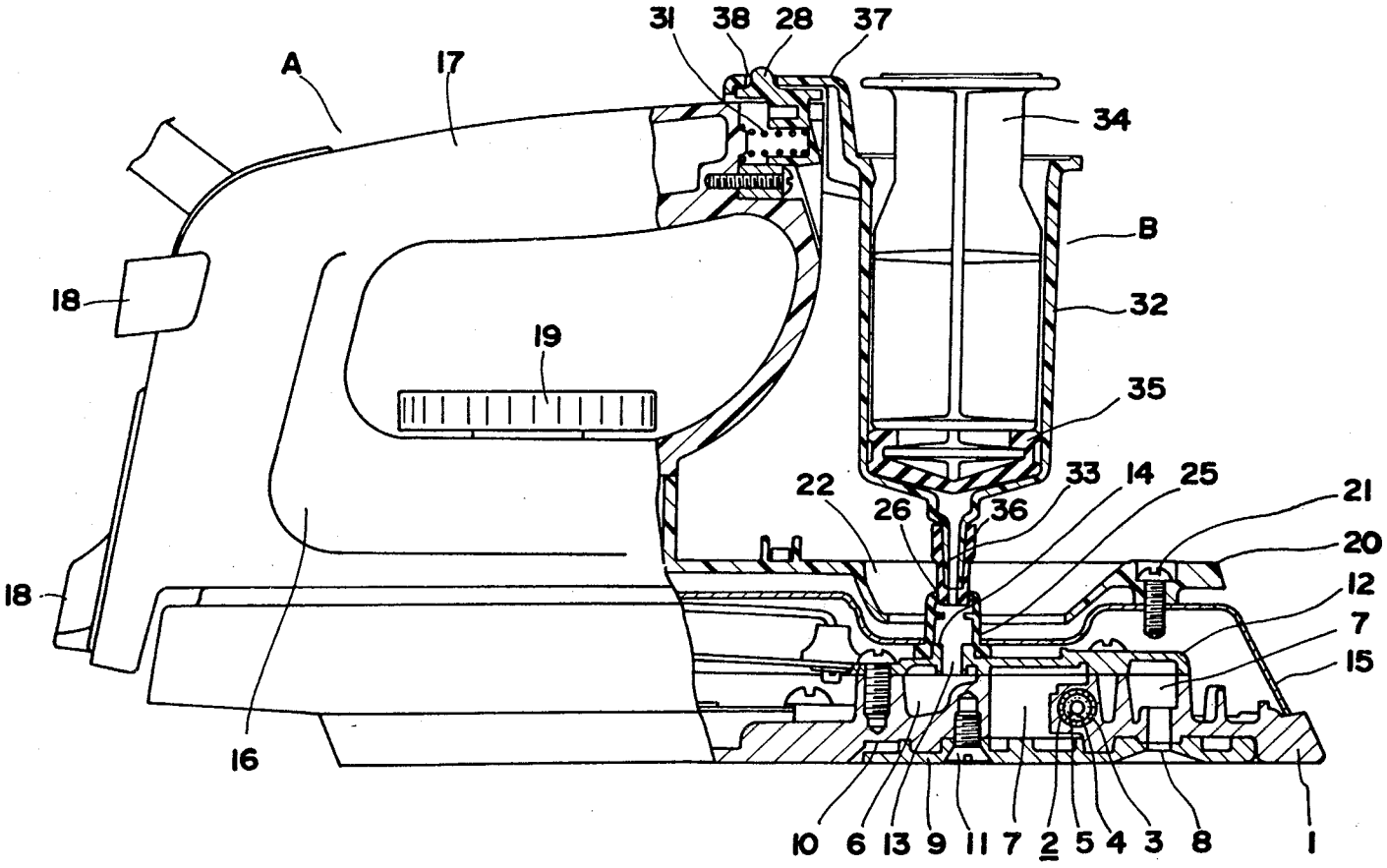
FIG. 2 is a view partly in section and showing the iron with a water pump mounted in position in place of the reservoir.

It is to be understood that FIG. 2 is similar to FIG. 1 except that the reservoir shown in FIG. 1 is replaced by the water pump in FIG. 2, the main portion of the iron shown in FIG. 2 being similar in construction to that shown in FIG. 1.

With reference to the drawings, indicated at 1 is a soleplate made of an aluminum alloy casting or the like, and at 2 a heater embedded in the soleplate 1 and extending in the form of a loop approximately along the outer peripheral edge of the soleplate 1. The heater 1 is of the sheathed type and comprises a protective sheath 3, an electric resistance wire 4 extending through the sheath 3, and a heat-resisting electric insulator 5, such as particulate magnesium oxide, for insulating the wire 4 from the sheath 3. The soleplate 1 is formed with a steam chamber 6 and a steam channel 7 communicating with the steam generating chamber 6 and also communicating with steam vents 8. A soleplate closure 9 is fitted in an inwardly recessed portion 10 of the soleplate 1 on the lower side thereof and is attached to the soleplate 1 with a screw 11. The soleplate 1 and the closure 9 provide a press surface for ironing. When the screw 11 is loosened, the soleplate closure 9 is removable from the soleplate 1 to expose a major portion of the steam channel 7. A soleplate cover 12 is attached to the upper side of the soleplate 1 in sealing contact therewith with a screw or by crimping to cover the chamber 6 and the channel 7 from above. The cover 12 has an opening 13 above the chamber 6. The opening 13 is surrounded by a flange 14 extending at least upward. A protective cover 15 provided above and attached to the soleplate 1 covers many parts mounted on the soleplate 1 and has a front portion which is partly recessed toward the soleplate 1.

A handle 16 provided on the cover 15 has a grip 17 and support portions 18 for allowing the main body A of the iron to stand by itself. A temperature adjusting dial 19 disposed below the grip 17 is coupled to a thermostat (not shown) incorporated in the iron main body. The temperature of the surface of the soleplate 1 is controllable as desired by the user by means of the dial 19. A heat shield 20 attached to a front portion of the cover 15 as by a screw 21 has a portion 22 recessed torward the cover 15.

FIG. 1 shows a reservoir 23 positionable in front of the handle 16 and detachably mountable on the iron main body A. The reservoir 23 is made of polycarbonate resin or the like and rendered wholly or partially transparent or semitransparent so that the amount of water contained therein can be observed. The reservoir 23 has an outlet nozzle 24 projecting downward from its bottom. When the reservoir 23 is attached to the main body A, the outlet nozzle 24 communicates with the steam generating chamber 6 via a seal member 25. The seal member 25 has its lower end fitted around the flange 14 on the soleplate cover 12, such lower end being held by the cover 15 attached to the soleplate 1, whereby the seal member 25 is permanently attached to the main body A (see FIG. 2). The seal member 25 is in the form of a tube made of silicone rubber or the like and has an orifice 26 in the upper end into which the outlet nozzle 24 is insertable. A holding portion 27 is formed on an upper portion of the reservoir 23 opposed to the handle 16. A lock knob 28 attached to the forward end of the grip 17 is engageable with the holding portion 27 to hold the reservoir connected to the iron main body A. In this state, the reservoir 23 is held in communication with the steam generating chamber 6 by the outlet nozzle 24 and the seal member 25. The outlet nozzle 24 is opened or closed by moving an opening rod 29 in the reservoir 23 upward or downward. The rod 29 is manipulated by a button 30 projecting from the top of the reservoir 23.

The steam iron having the detachable reservoir is used in the following manner. The water in the reservoir 23 falls dropwise into the steam generating chamber 6 from the outlet nozzle 24 opened by pulling up the rod 29, through the seal member 25. The water drops instantaneously evaporate in the chamber 6, and the resulting steam passes through the steam channel 7 and is released from the steam vents 8. During ironing, the steam is discharged and stopped by moving the rod 29 upward and downward. The reservoir 23 is removable by sliding the lock knob 28 in the direction of arrow a. The lock knob 28 is usually biased by a member 31, such as a spring, toward the reservoir 23 into engagement with the holding portion 27 of the reservoir 23. The holding portion 27 is disengageable from the knob 28 by sliding the knob 28.

With reference to FIG. 2, a cleaning attachment will be described in detail which is used for the steam iron described. A water pump B comprises a cylinder 32 of polypropylene or like thermoplastic resin having a discharge nozzle 33 formed with an orifice at its lower end. A piston 34 recriprocably movable in the cylinder 32 has a packing 35 on the end adjacent the discharge nozzle 33. The periphery of packing 35 is in sealing contact with the inner surface of the cylinder 32. The other end of the piston 34 extends outward from a large open end of the cylinder 32. The discharge nozzle 33 is externally covered with a protective tube 36 made of heat-resisting silicone rubber and having an orifice of substantially the same size as the orifice of the nozzle 33. A support 37 integral with the cylinder 32 extends therefrom toward the handle 16. The support 37 has a hole 38 through which the lock knob 28 is inserted when the support 37 is fixed to a front portion of the grip 17 of the handle 16.

The water pump B is used for cleaning the steam generating chamber 6, the steam channel 7 and the steam vents 8 after the reservoir 23 is removed from the iron main body A. The water pump B must be filled with water before being attached to the iron main body A, by advancing the piston 34 deep into the cylinder 32, then immersing the discharge nozzle 33 in water placed in a suitable container and thereafter retracting the piston 34 away from the nozzle. The water pump B thus filled with water is attached to the iron main body A as shown in FIG. 3. At this time, the discharge nozzle 33 is inserted into the orifice 26 of the seal member 25 along with the protective tube 36, and the pump B is held approximately vertically by the handle 16 with the support 37.

Preferably the iron is cleaned by the water pump B when the soleplate 1 of the iron is not fully cooled, i.e. immediately after ironing while the soleplate 1 is still hot. For cleaning, the water in the cylinder 32 is injected into the steam generating chamber 6 by depressing the piston 34 while holding the iron main body A substantially horizontally with the hand grapsing the grip 17 of the handle 16. The water is partly turned into steam by the heat of the soleplate 1, while the remaining portion of the water is heated to a high temperature. The steam produced at this time imparts an additional force to the flow of water. The hot water and steam pass through the steam channel 7 and are discharged from the steam vents 8 while forcibly removing lint and evaporation deposit from the chamber 6, the channel 7 and vents 8 to discharge them from the vents 8 along with the hot water.

Thus, the cleaning attachment, namely the water pump B, for the steam iron of the present invention is separable from the iron main body and is interchangeable with the reservoir 23 which is detachably mountable on the iron main body. Accordingly when there arises a need for cleaning, the reservoir is replaced by the water pump, so that it is unlikely that the pump will be inadvertently operated during ironing. Because a predetermined amount of fresh water is drawn into the water pump for cleaning every time the iron is to be cleaned, instead of using the steam generating water remaining in the reservoir, a sufficient quantity of water is available every time. Additionally, the water is forcibly compressed within the cylinder by the piston and injected into the steam generating chamber from the discharge nozzle 33, whereby evaporation deposit and the like can be washed away from the steam generating chamber and the steam channel with greatly improved effectiveness. Furthermore the water pump can be supported in an approximately vertical position by the iron main body, with its discharge nozzle connected to the soleplate. This enables the user to depress the piston with the hand by which the iron main body is held horizontally as illustrated in FIG. 4. The pump can therefore be operated while being held away from the human body. Thus the pump is usable with safety free of the likelihood that the human body will be exposed to the hot water or steam jetting out from the steam vents.

Since the discharge nozzle of the water pump is inserted along with the protective tube into the orifice of the tubular seal member attached to the soleplate and is thereby connected to the seal member, no water will leak from the connection when the water is compressed by depressing the piston. Further even when the nozzle is inserted into the seal member in an inclined direction, the seal member will incline in the same direction to prevent the leak from the connection. The seal member and the protective tube shield the water pump from the heat of the soleplate and prevent the pump from being heated to a high temperature.

What is claimed is:

1. A steam iron set comprising a soleplate having a heater, a steam generating chamber formed in the soleplate, a steam channel for guiding the steam generated in the steam generating chamber to steam vents formed in an ironing surface, an iron main body having a fixed handle above the soleplate, a reservoir detachably mountable on the iron main body and provided at its bottom with an outlet nozzle connectable to passage means communicating with the steam generating chamber, the reservoir further being provided with means for controlling the supply of water to the steam generating chamber through the outlet nozzle, and a water pump mountable on the iron main body in exchange for the reservoir and having a discharge nozzle connectable to the passage means, the water pump being adapted to forcibly release water therefrom, pass the water through the steam generating chamber and the steam channel and vigorourly discharge the water from the steam vents.

2. A steam iron set as defined in claim 1 wherein the passage means comprises an opening disposed above the steam generating chamber and a seal member provided above the opening and having an orifice communicating with the opening, and the discharge nozzle of the water pump and the outlet nozzle of the reservoir being insertable into the orifice of the seal member.

3. A steam iron set as defined in claim 2 wherein the seal member comrises a base end portion fixedly fittable around the opening of the steam generating chamber and a tubular portion extending upward from the base end portion.

4. A steam iron set as defined in claim 1 wherein the water pump comprises a cylinder having the discharge nozzle at its lower end and a piston slidable in the cylinder.

5. A steam iron set as defined in claims 1 or 4 wherein the discharge nozzle of the water pump is externally covered with a heat-resisting protective tube.

6. The steam iron set as defined in claim 1 wherein the water pump has a support removably attachable to the iron main body.

7. A steam iron set as defined in claim 6 wherein the water pump comprises a cylinder having the discharge nozzle at its lower end and a piston slidable in the cylinder, and the support extends from the cylinder and is intergral therewith.

8. A steam iron set as defined in claim 6 wherein when the water pump is mounted in place, the support extends toward the handle and can be fixed to a front portion of the handle.

9. A steam iron set as defined in claim 8 wherein when the water pump is mounted in place, the support surrounds a lock knob on the handle front portion to hold the water pump to the iron main body, whereby the support can be fixed to the handle front portion.

* * * * *